US007587797B2

(12) United States Patent
Sell

(10) Patent No.: US 7,587,797 B2
(45) Date of Patent: Sep. 15, 2009

(54) SOCK KEEPER

(76) Inventor: Timothy L. Sell, 6993 Brook Trout La., Plymouth, MI (US) 48170

( * ) Notice: Subject to any disclaimer, the term of this patent is extended or adjusted under 35 U.S.C. 154(b) by 142 days.

(21) Appl. No.: 11/784,084

(22) Filed: Apr. 5, 2007

(65) Prior Publication Data

US 2008/0244877 A1 Oct. 9, 2008

(51) Int. Cl.
*A44B 18/00* (2006.01)

(52) U.S. Cl. ..... 24/442; 24/DIG. 29

(58) Field of Classification Search ..... 24/306, 24/442, DIG. 29, 16 R; 128/DIG. 15; 428/100; 224/901.4
See application file for complete search history.

(56) References Cited

U.S. PATENT DOCUMENTS

| | | | |
|---|---|---|---|
| 1,199,595 | A | 9/1916 | Noble |
| 1,859,817 | A | 5/1932 | Dodd |
| 2,663,877 | A | 12/1953 | Bohman |
| 2,779,076 | A | 1/1957 | Schenck |
| 2,818,871 | A | 1/1958 | Beaudry |
| 2,937,934 | A | 5/1960 | Orenick |
| 3,041,743 | A | 7/1962 | Monsma |
| 3,086,529 | A | 4/1963 | Munz |
| 3,170,213 | A | 2/1965 | Thomas |
| 3,279,008 | A | 10/1966 | Wallach |
| 3,346,927 | A | 10/1967 | Tomkins |
| 3,383,738 | A | 5/1968 | Fox |
| 3,390,680 | A | 7/1968 | Marcum |
| 3,414,944 | A | 12/1968 | Rabinowitz |
| 3,606,651 | A | 9/1971 | Goodman |
| 3,673,639 | A | 7/1972 | Driscoll |
| 3,688,348 | A | 9/1972 | Klotz |
| 3,699,617 | A | 10/1972 | Hoffmeister |
| 3,774,267 | A | 11/1973 | Sneider |
| 4,058,853 | A | 11/1977 | Boxer et al. |
| 4,414,716 | A | 11/1983 | Stastney |
| 4,682,389 | A | 7/1987 | Callender |
| 4,939,823 | A | 7/1990 | Klein |
| 5,038,413 | A | 8/1991 | Ursino |
| 5,321,855 | A | 6/1994 | Ciuffo |
| 5,357,660 | A | 10/1994 | Smith |
| 5,381,588 | A | 1/1995 | Nelson |
| 5,440,791 | A | 8/1995 | Guio |
| 5,450,658 | A | 9/1995 | Hicks |

(Continued)

*Primary Examiner*—James R Brittain
(74) *Attorney, Agent, or Firm*—Andrew W. Ludy

(57) ABSTRACT

A sock keeper holds clothing items together in the laundry. A flexible base extends between opposite first and second edges, and between opposite ends. One of the base ends has a first tab projecting outward adjacent the base first edge. The opposite base end has a second tab projecting outward adjacent the base second edge. The tabs are thereby spaced apart, allowing manual grasping of the tabs separately.

A flexible tail extends from a proximal end adjacent the base first edge to an opposite distal end. The tail surface is made from the loop portion of hook-and-loop material, to ensure that the tail surface does not catch on any clothing items in the wash.

The tail closely encircles the clothing items. A base panel on the base upper surface is made from the hook portion of hook-and-loop material, so as to releasably engage the tail surface, defining a primary fastener. The base panel ends releasably engage one another above the tail distal end, defining a secondary fastener. The secondary fastener secures the primary fastener in place, so that the clothing items will not separate in the wash.

14 Claims, 9 Drawing Sheets

U.S. PATENT DOCUMENTS

| | | | | |
|---|---|---|---|---|
| 5,499,431 | A | 3/1996 | Mortensen | |
| 5,579,541 | A | 12/1996 | Christy | |
| 5,740,558 | A | 4/1998 | Messman | |
| 5,918,318 | A | 7/1999 | Jones | |
| 5,944,236 | A | 8/1999 | Cinque | |
| 6,032,294 | A | 3/2000 | Dean | |
| 6,092,241 | A | 7/2000 | Bellet | |
| 6,161,263 | A | 12/2000 | Anderson | |
| 6,317,933 | B1 * | 11/2001 | Suenaga | 24/16 R |
| 6,463,636 | B1 | 10/2002 | Friedewald | |

* cited by examiner

SOCK KEEPER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of clothing fasteners, and more particularly to a—fastener or keeper to hold a pair of socks together for laundering.

Sock pairs become separated in the laundry, and must be paired up after drying. Devices to keep socks together are known, and some prior art patents are as follows:

Klotz, U.S. Pat. No. 3,688,348; Marcum, U.S. Pat. No. 3,390,680; Wallach, U.S. Pat. No. 3,279,008; and Munz, U.S. Pat. No. 3,086,529; each disclose a strip of fabric with Velcro® on both sides. The strip is wrapped around the socks, and secured against a portion of loops facing outward. The hooks of Klotz face inward, engaging the socks. All of the references show exposed hook material that can catch on other items in the wash. None of the references shows a secondary latching structure to ensure that the keeper stays secured.

Jones, U.S. Pat. No. 5,918,318; Christy, U.S. Pat. No. 5,579,541; Ciuffo, U.S. Pat. No. 5,321,855; and Boxer, U.S. Pat. No. 4,058,853; each disclose a Velcro® fastener sewn permanently onto each sock. The fastener does not encircle the socks, but connects the ends.

Accordingly, there is a need to provide a sock keeper that has no exposed hooks, but has only loops exposed, so as not to catch on the socks or other laundry items, or pick up lint in the washer or dryer.

There is a further need to provide a sock keeper of the type described and that has a secondary fastening portion to ensure that the keeper does not loosen in the laundry.

There is a yet further need to provide a sock keeper of the type described and that does not require being sewn or attached permanently to the socks.

There is a still further need to provide a sock keeper of the type described and that can be manufactured cost-effectively in large quantities of high quality.

BRIEF SUMMARY OF THE INVENTION

In accordance with the present invention, there is provided a sock keeper constructed in accordance with the invention. A base extends between opposite first and second edges. The base extends between opposite ends. One of the base ends has a first tab projecting outward adjacent the base first edge. The opposite base end has a second tab projecting outward adjacent the base second edge. The tabs are thereby spaced apart, allowing manual grasping of the tabs separately. The base is made from a flexible material.

A tail extends from a proximal end adjacent the base first edge to an opposite distal end. The tail has a surface. The tail is made from a flexible material. The tail surface is made from hook-and-loop material, and specifically the loop portion. This is to ensure that the tail surface does not catch on any clothing items in the wash.

At least one base panel is attached to the base upper surface. The base panel is made of hook-and-loop material, and specifically the hook portion, so as to engage the tail surface. The base panel has first and second edges juxtaposed with the base first and second edges, respectively. The base panel has ends juxtaposed with the base ends.

In practice, the tail will be moved in an arc downward, and will closely encircle the clothing items. The tail will then pass upward over the base second edge and over the base upper surface. The tail surface will releasably engage the base panel. This engagement will define a primary fastener. The base panel tabs will be grasped separately, and the base panel ends will be moved upward and toward one another. The base panel ends will releasably engage one another above the tail distal end. This engagement will define a secondary fastener. The secondary fastener will secure the primary fastener in place, ensuring that the clothing items will not separate in the agitation of washing and drying.

BRIEF DESCRIPTION OF THE SEVERAL VIEWS OF THE DRAWING

A more complete understanding of the present invention may be obtained from consideration of the following description in conjunction with the drawing, in which.

DETAILED DESCRIPTION OF THE INVENTION

Figure 1:
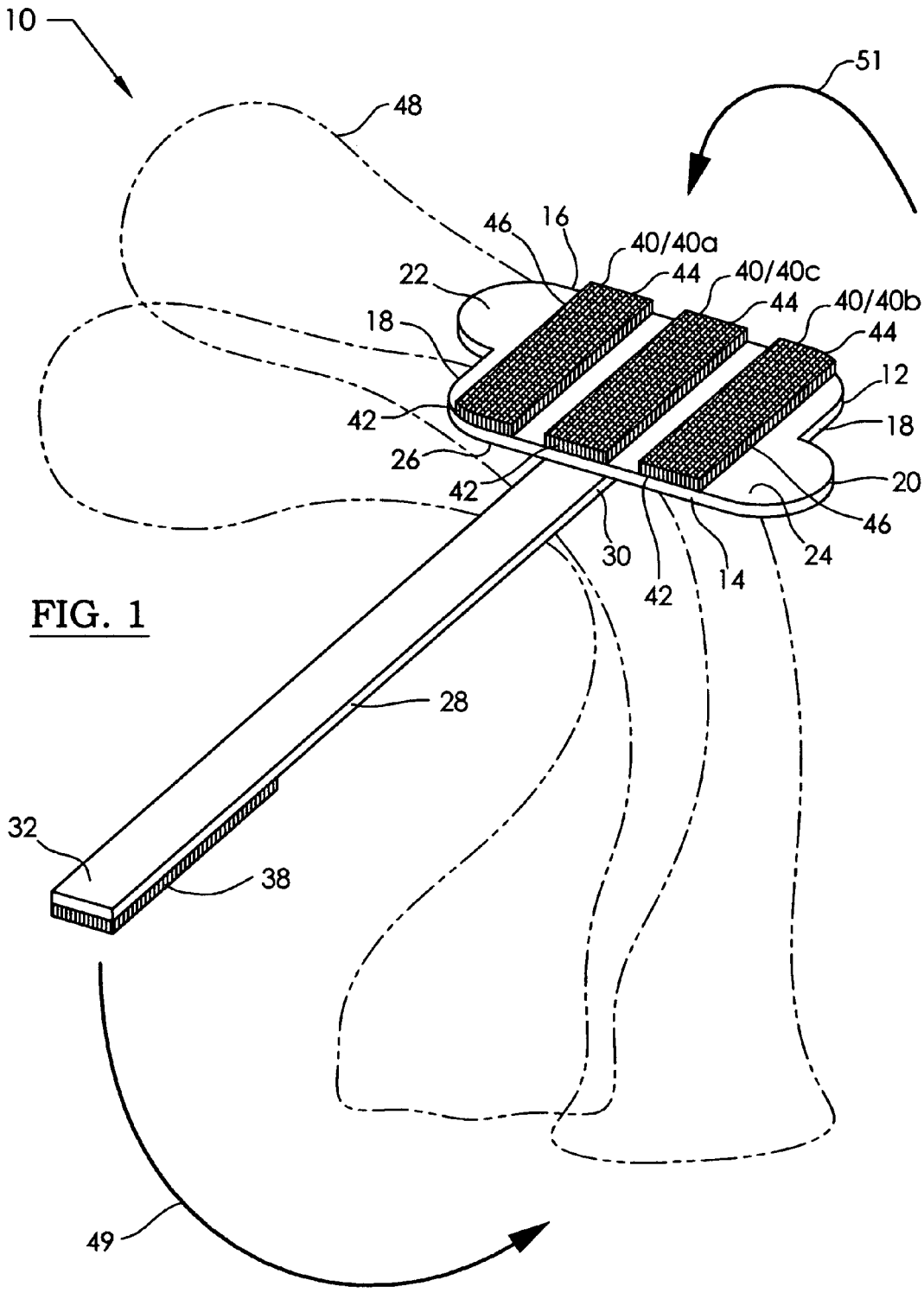
FIG. 1 is a perspective view of a sock keeper constructed in accordance with the invention, showing the keeper in the open position.
Figures 2, 7:
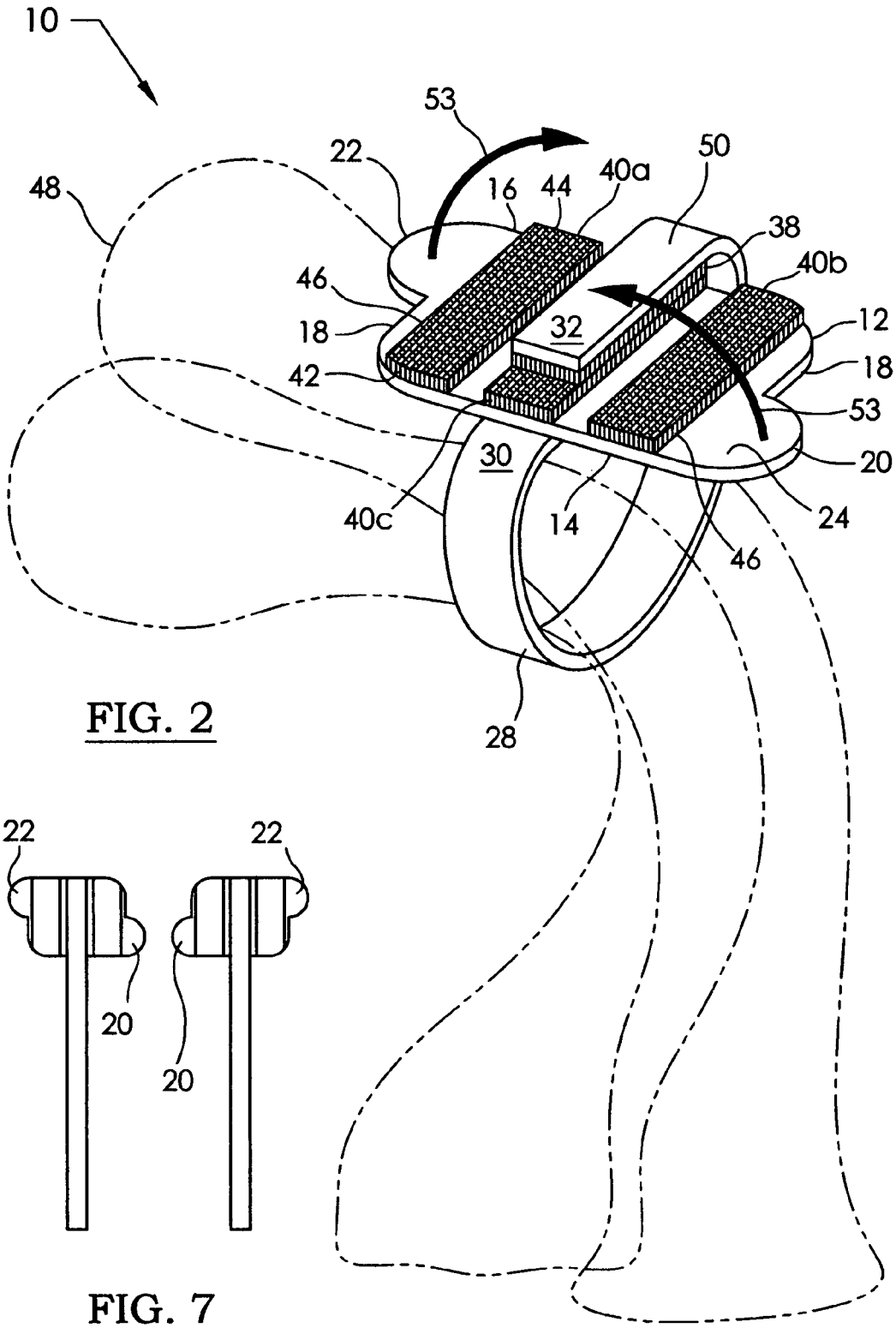
FIG. 2 is a perspective view of the sock keeper of FIG. 1, showing the keeper in the primary secured position.
FIG. 7 is a top plan view of the sock keeper of FIG. 1, showing the tabs in two alternate positions.
Figure 3:
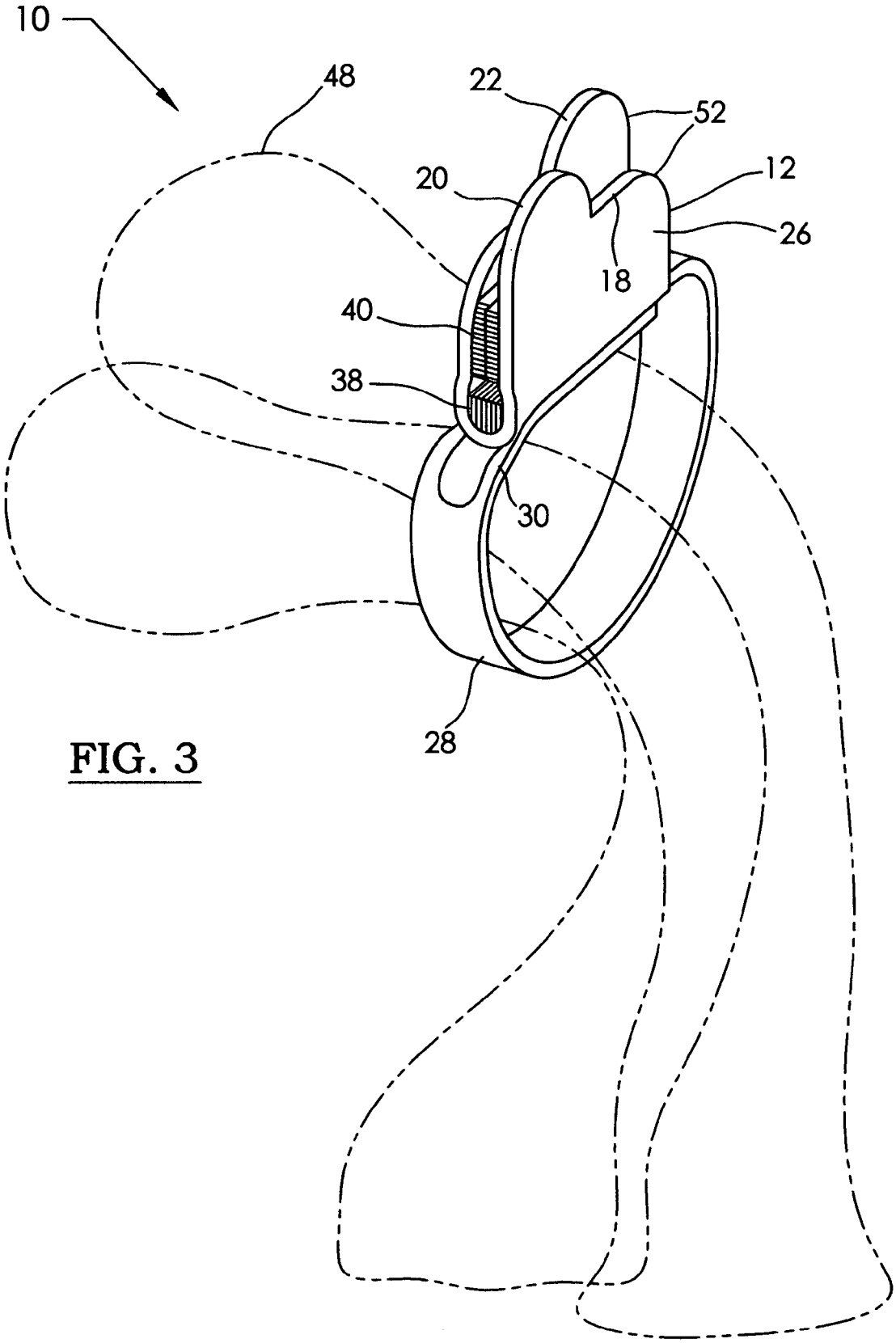
FIG. 3 is a perspective view of the sock keeper of FIG. 1, showing the keeper in the primary and secondary secured position.
Figure 4:
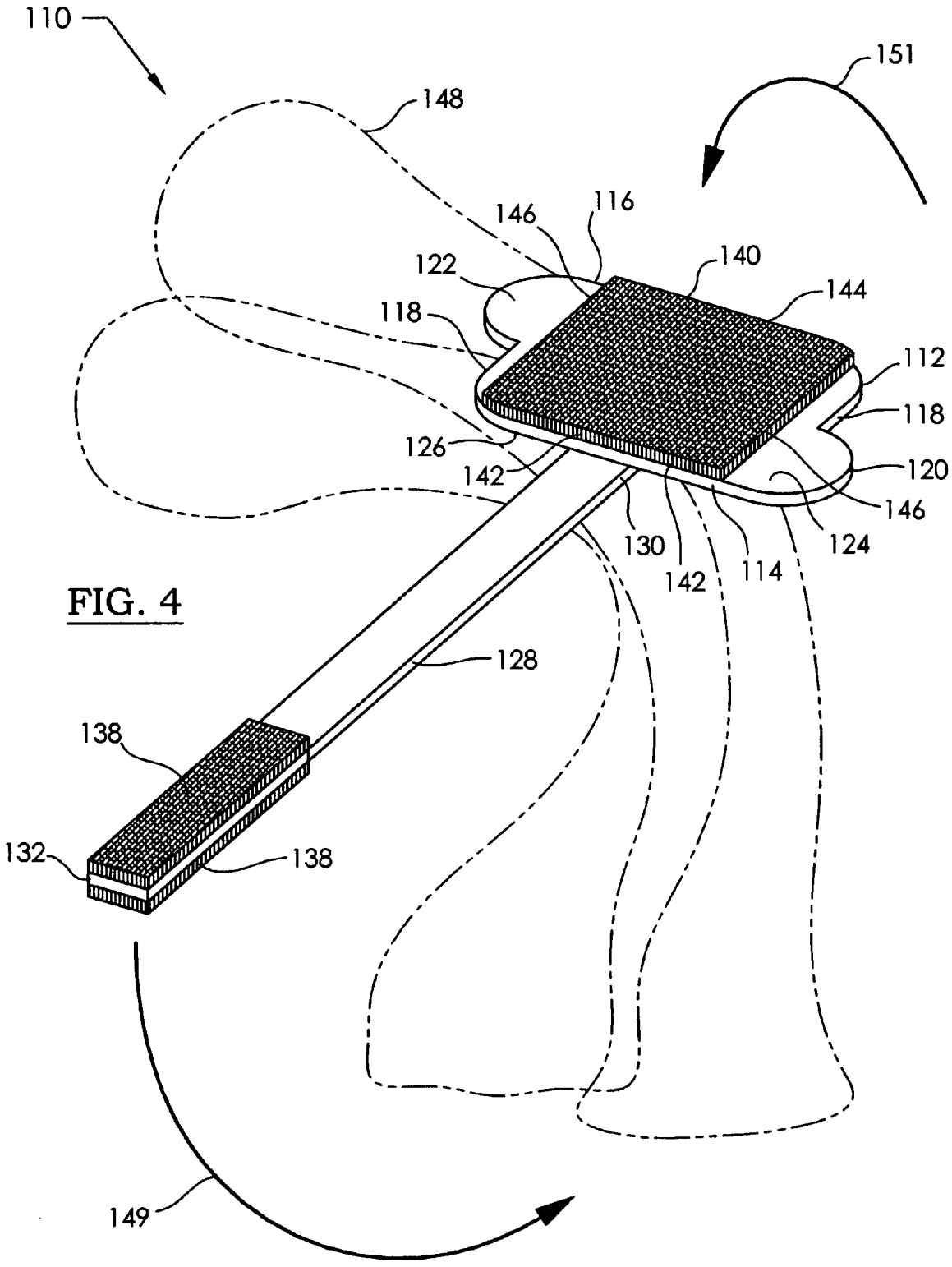
FIG. 4 is a perspective view of another sock keeper constructed in accordance with the invention, showing the keeper in the open position.

Referring now to the drawing, and especially to FIGS. 1, 2, and 3 thereof, a sock keeper constructed in accordance with the invention is shown at 10, and is used for holding a plurality of clothing items together in close juxtaposition in a washing machine and a dryer, thus obviating the need to pair the socks later. The sock keeper 10 comprises a base 12 extending between opposite first 14 and second 16 edges. The base 12 extends between opposite ends 18. One of the base ends 18 has a first tab 20 projecting outward adjacent the base first edge 14. The opposite base end 18 has a second tab 22 projecting outward adjacent the base second edge 16. The first 20 and second 22 tabs are thereby spaced apart, allowing manual grasping of the tabs separately. The first 20 and second 22 tabs can be aligned with either of the base ends 18, as shown in FIG. 7. The base 12 has opposite upper 24 and lower 26 surfaces. The base 12 is made from a flexible material.

A tail 28 extends from a proximal end 30 adjacent the base first edge 14 to an opposite distal end 32. The tail 28 is generally flat in cross-section, and has a surface 38. The tail 28 is made from a flexible material. The tail surface 38 is made from hook-and-loop material, and specifically the loop portion. This is to ensure that the tail surface 38 does not catch on any clothing items in the wash.

In general, at least one base panel 40 is attached to the base upper surface 24. The base panel 40 is made of hook-and-loop material. The base panel 40 extends between opposite first 42 and second 44 edges. The base panel 40 extends between opposite ends 46. The base panel first 42 and second 44 edges are juxtaposed with the base first 14 and second 16 edges, respectively. The base panel ends 46 are juxtaposed with the base ends 18.

In practice, the tail 28 will be moved in an arc downward, and will closely encircle the clothing items 48, as shown by arrow 49. The tail 28 will then pass upward over the base second edge 16 and over the base upper surface 24, as shown by arrow 51. The tail surface 38 will releasably engage the base panel 40. This engagement will define a primary fastener 50. The base panel tabs 20 and 22 will be grasped separately, and the base panel ends 18 will be moved upward and toward one another, as shown by arrows 53. The base panel ends 18 will releasably engage one another above the tail distal end 32, as shown in FIG. 3. This engagement will define a secondary fastener 52. The secondary fastener 52 will secure the primary fastener 50 in place, ensuring that the clothing items 48 will not separate in the agitation of washing and drying.

In particular, the base panel 40 is comprised of three parts. A central base panel 40*c* has hook material so as to engage the tail surface 38 and secure the primary fastener 50, as shown in FIG. 2. A first end base panel 40*a* includes hook material. A second end base panel 40*b* has loop material so as to engage the first end base panel 40*a*, and secure the secondary fastener 52. The first 40*a* and second 40*b* end base panels straddle the central base panel 40*c*. The first 40*a* and second 40*b* end base panels are disposed adjacent the base ends 18. The central base panel 40*c*, first end base panel 40*a*, and second end base panel 40*b*, all extend generally between the base first 14 and second 16 edges.

Figures 5, 8:
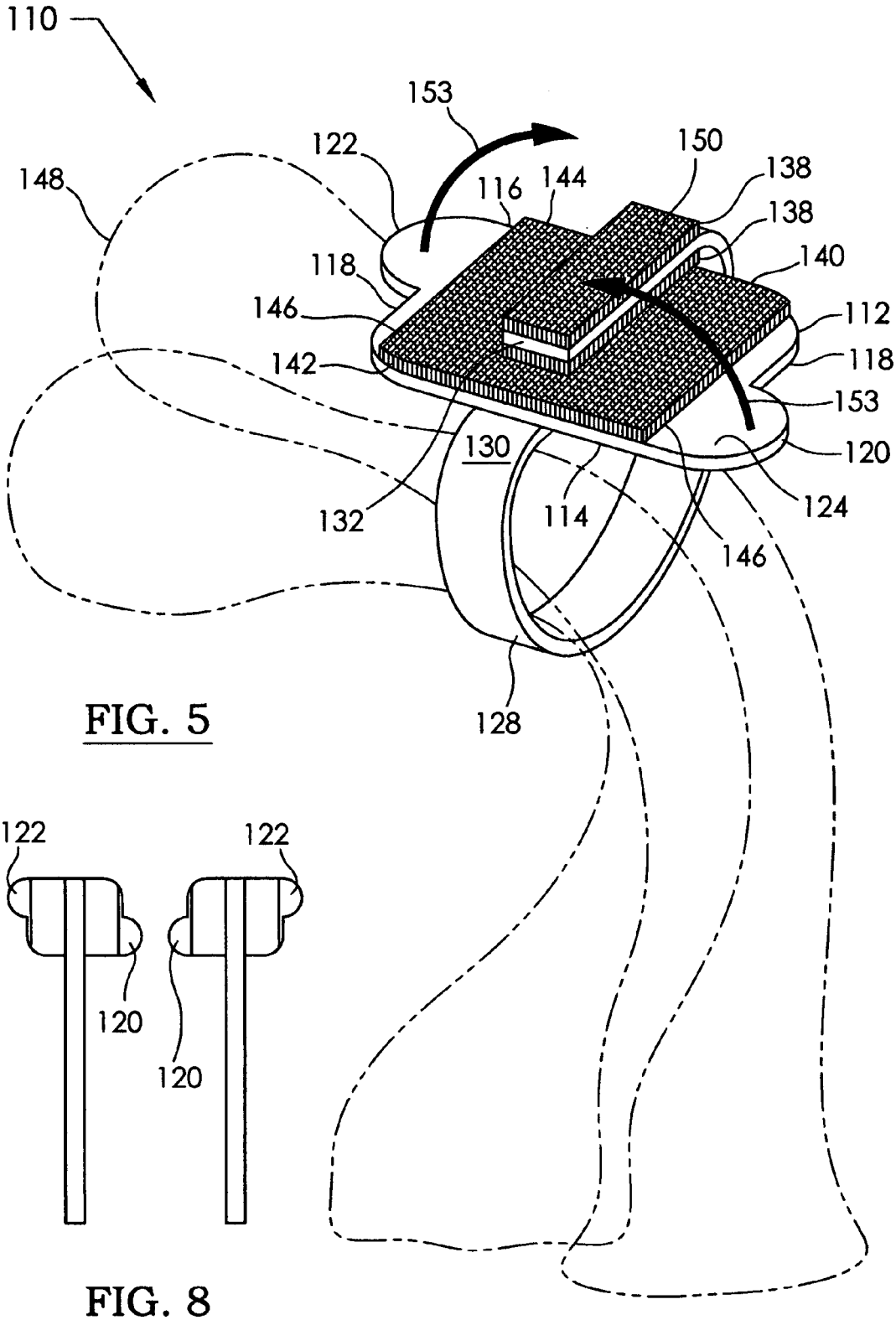
FIG. 5 is a perspective view of the sock keeper of FIG. 4, showing the keeper in the primary secured position.
FIG. 8 is a top plan view of the sock keeper of FIG. 4, showing the tabs in two alternate positions.
Figure 6:
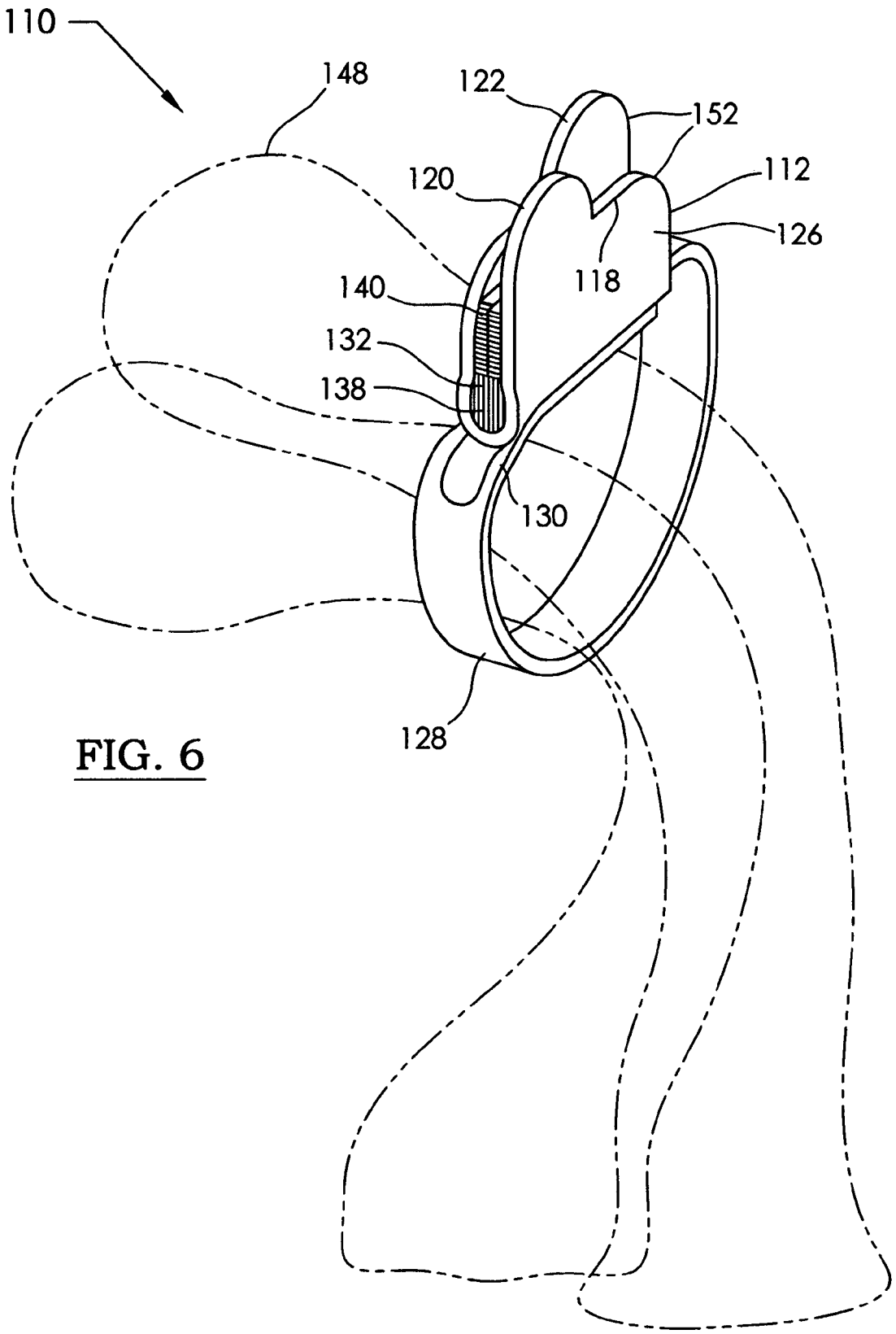
FIG. 6 is a perspective view of the sock keeper of FIG. 4, showing the keeper in the primary and secondary secured position.
Figure 9:
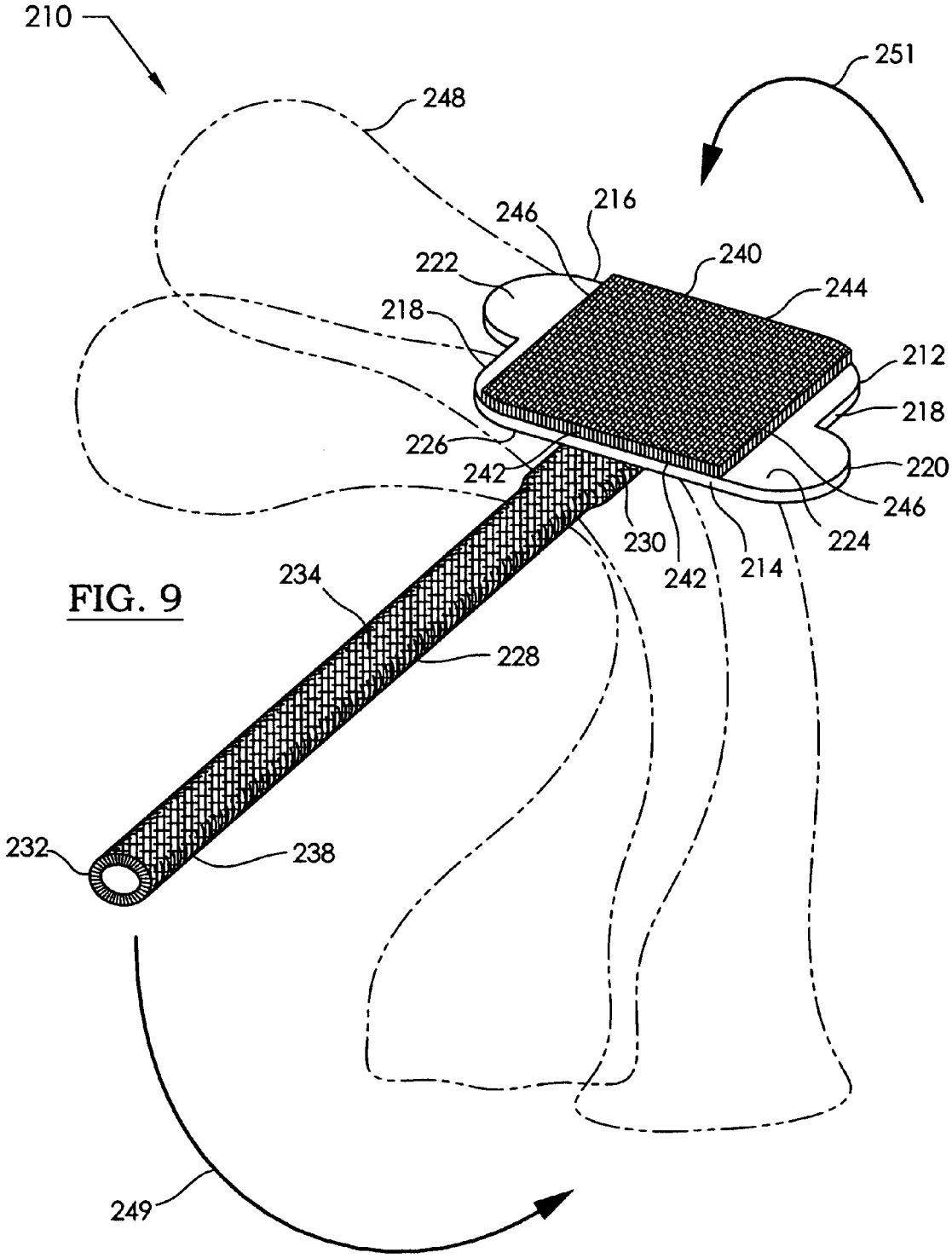
FIG. 9 is a perspective view of yet another sock keeper constructed in accordance with the invention, showing the keeper in the open position.
Figure 10:
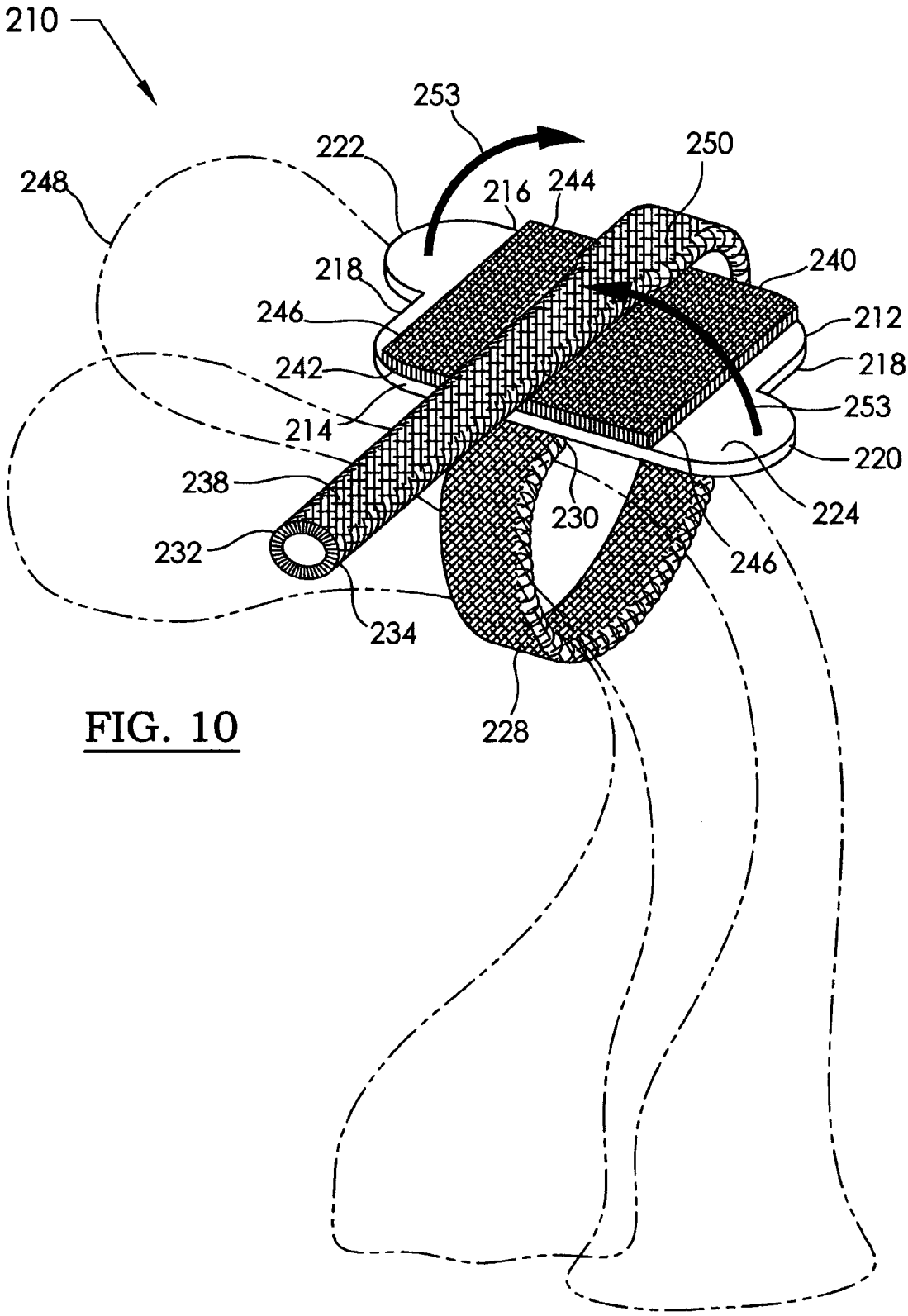
FIG. 10 is a perspective view of the sock keeper of FIG. 9, showing the keeper in the primary secured position.

Turning now to FIGS, 4, 5, and 6, another sock keeper constructed in accordance with the invention is shown at 110, and is similar to sock keeper 10 described above, in that the sock keeper 110 comprises a base 112 extending between opposite first 114 and second 116 edges. The base 112 extends between opposite ends 118. One of the base ends 118 has a first tab 120 projecting outward adjacent the base first edge 114. The opposite base end 118 has a second tab 122 projecting outward adjacent the base second edge 116. The first 120 and second 122 tabs are thereby spaced apart, allowing manual grasping of the tabs separately. The first 120 and second 122 tabs can be aligned with either of the base ends 118, as shown in FIG. 8. The base 112 has opposite upper 124 and lower 126 surfaces. The base 112 is made from a flexible material.

A tail 128 extends from a proximal end 130 adjacent the base first edge 114 to an opposite distal end 132. The tail 128 is generally flat in cross-section, and has a surface 138. The tail 128 is made from a flexible material. The tail surface 138 is made from hook-and-loop material, and specifically the loop portion. This is to ensure that the tail surface 138 does not catch on any clothing items in the wash.

Sock keeper 110 differs from sock keeper 10 described above, in that only one base panel 140 is attached to the base upper surface 124. The base panel 140 is made of hook-and-loop material, and specifically the hook portion, so as to engage the tail surface 138. The base panel 140 extends between opposite first 142 and second 144 edges. The base panel 140 extends between opposite ends 146. The base panel first 142 and second 144 edges are juxtaposed with the base first 114 and second 116 edges, respectively. The base panel ends 146 are juxtaposed with the base ends 118.

In practice, the tail 128 will be moved in an arc downward, and will closely encircle the clothing items 148, as shown by arrow 149. The tail 128 will then pass upward over the base second edge 116 and over the base upper surface 124, as shown by arrow 151. The tail surface 138 will releasably engage the base panel 140. This engagement will define a primary fastener 150. The base panel tabs 120 and 122 will be grasped separately, and the base panel ends 118 will be moved upward and toward one another, as shown by arrows 153. The base panel ends 118 will releasably engage one another above and closely adjacent the tail distal end 132. The base panel ends 118 will also releasably engage the tail surface 138. These engagements will define a secondary fastener 152. The secondary fastener 152 will secure the primary fastener 150 in place, ensuring that the clothing items 148 will not separate in the agitation of washing and drying.

Referring now to FIGS, 9, 10, and 11, yet another sock keeper constructed in accordance with the invention is shown at 210, and is similar to sock keeper 110 described above, in that the sock keeper 210 comprises a base 212 extending between opposite first 214 and second 216 edges. The base 212 extends between opposite ends 218. One of the base ends 218 has a first tab 220 projecting outward adjacent the base first edge 214. The opposite base end 218 has a second tab 222 projecting outward adjacent the base second edge 216. The first 220 and second 222 tabs are thereby spaced apart, allowing manual grasping of the tabs separately. The first 220 and second 222 tabs can be aligned with either of the base ends 218. The base 212 has opposite upper 224 and lower 226 surfaces. The base 212 is made from a flexible material.

Sock keeper 210 differs from sock keeper 110 described above, in that a tail 228 extends from a proximal end 230 adjacent the base first edge 214 to an opposite distal end 232. The tail 228 is generally round in cross-section, and has a surface 238. The tail 228 cross-section has a periphery 234, and the tail surface 238 includes loop material around the periphery 234, so as to increase the area of contact of the primary fastener. The tail 228 is made from a flexible material. The tail surface 238 is made from hook-and-loop material, and specifically the loop portion. This is to ensure that the tail surface 238 does not catch on any clothing items in the wash.

At least one base panel 240 is attached to the base upper surface 224. The base panel 240 is made of hook-and-loop material. The base panel 240 extends between opposite first 242 and second 244 edges. The base panel 240 extends between opposite ends 246. The base panel first 242 and second 244 edges are juxtaposed with the base first 214 and second 216 edges, respectively. The base panel ends 246 are juxtaposed with the base ends 218.

Figure 11:
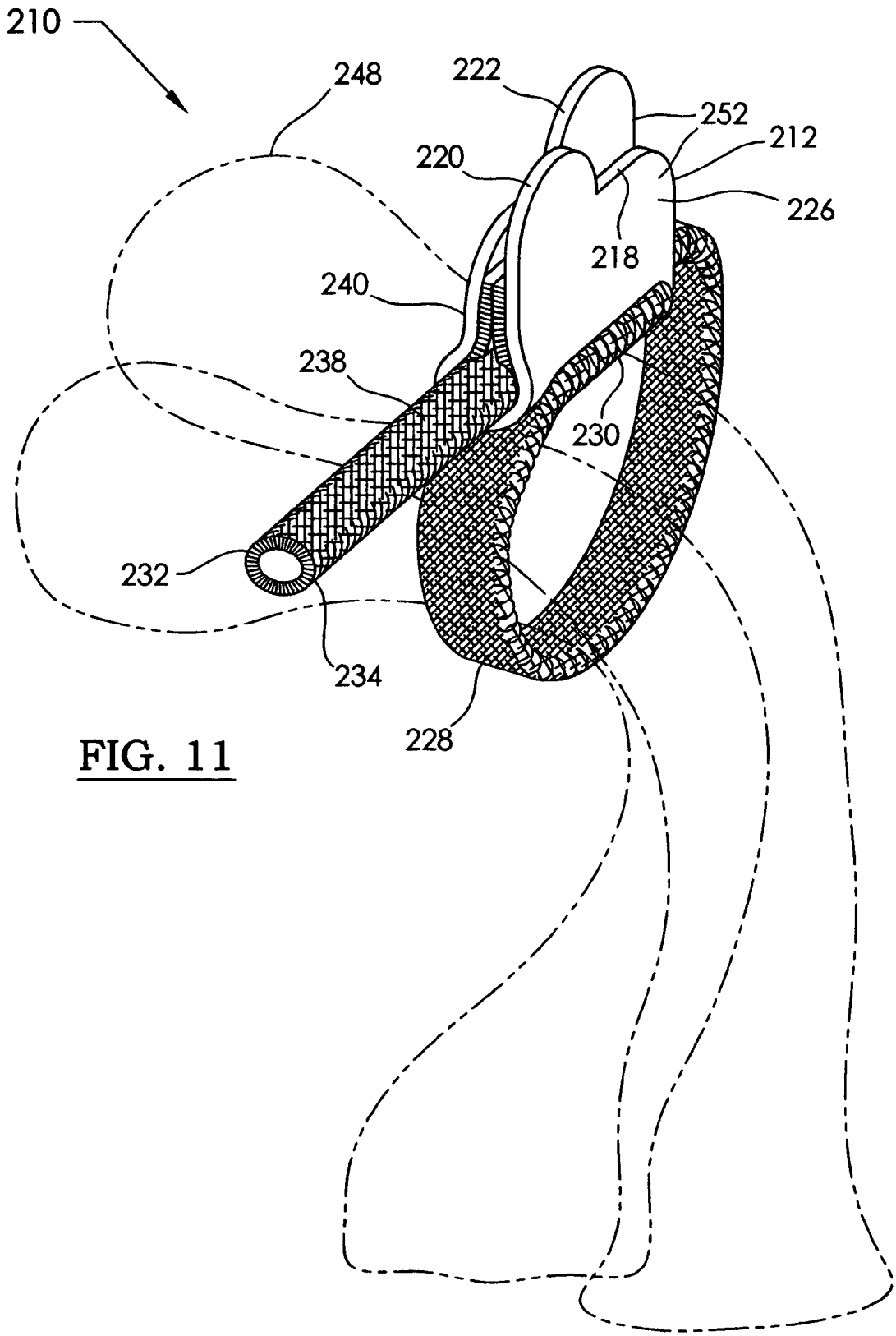
FIG. 11 is a perspective view of the sock keeper of FIG. 9, showing the keeper in the primary and secondary secured position.

In practice, the tail 228 will be moved in an arc downward, and will closely encircle the clothing items 248, as shown by arrow 249. The tail 228 will then pass upward over the base second edge 216 and over the base upper surface 224, as shown by arrow 251. The tail surface 238 will releasably engage the base panel 240. This engagement will define a primary fastener 250. The base panel tabs 220 and 222 will be grasped separately, and the base panel ends 218 will be moved upward and toward one another, as shown by arrows 253. The base panel ends 218 will releasably engage one another above the tail distal end 232, as shown in FIG. 11. This engagement will define a secondary fastener 252. The secondary fastener 252 will secure the primary fastener 250 in place, ensuring that the clothing items 248 will not separate in the agitation of washing and drying.

In all embodiments of the invention, the base portion of the sock keeper 10, 110, and 210, can be made from polymeric or natural materials. The hook-and-loop material is typically made from a polymeric material for required stiffness of the hooks. The sock keeper can be color-coded to aid in sorting laundry. Wall panels of hook-and-loop material (not shown) can be mounted on the walls of a closet for hanging laundry items in storage.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTS LIST

Sock Keeper

Part
No. Description
10 sock keeper
12 base
14 base first edge
16 base second edge
18 base ends
20 first tab
22 second tab
24 base upper surface
26 base lower surface
28 tail
30 tail proximal end
32 tail distal end
38 tail surface
40 base panel
40*a* first end base panel
40*b* second end base panel
40*c* central base panel
42 base panel first edge
44 base panel second edge
46 base panel ends
48 clothing items
49 tail down arrow
50 primary fastener
51 tail over arrow
52 secondary fastener
53 tabs up arrows
110 sock keeper
112 base
114 base first edge
116 base second edge
118 base ends
120 first tab
122 second tab
124 base upper surface
126 base lower surface
130 tail proximal end
128 tail
132 tail distal end
138 tail surface
140 base panel
142 base panel first edge
144 base panel second edge
146 base panel ends
148 clothing items
149 tail down arrow
150 primary fastener
151 tail over arrow
152 secondary fastener
153 tabs up arrows
210 sock keeper
212 base
214 base first edge
216 base second edge
218 base ends
220 first tab
222 second tab
224 base upper surface
226 base lower surface
228 tail
230 tail proximal end
232 tail distal end
234 tail periphery
238 tail surface
240 base panel
242 base panel first edge
244 base panel second edge
246 base panel ends
248 clothing items
249 tail down arrow
250 primary fastener
251 tail over arrow
252 secondary fastener
253 tabs up arrows The embodiments of the invention in which an exclusive property or privilege is claimed are defined as follows:

1. A sock keeper for holding a plurality of clothing items together in close juxtaposition, the sock keeper comprising:

a base extending between opposite first and second edges and between opposite ends, one of the base ends having a first tab projecting outward adjacent the base first edge, the opposite base end having a second tab projecting outward adjacent the base second edge, so as to space apart the first and second tabs, allowing manual grasping of the tabs separately, the base having opposite upper and lower surfaces, the base being flexible;

at least one base panel attached to the base upper surface, the base panel extending between opposite first and second edges and between opposite ends, the base panel first and second edges being juxtaposed with the base first and second edges, respectively, the base panel ends being juxtaposed with the base ends, the base panel being a hook component of hook-and-loop material; and a tail extending from a proximal end adjacent the base first edge to an opposite distal end, the tail being flexible, the tail having a surface of a loop component of hook-and-loop material, so as to engage the base panel and not catch on clothing items; so that the tail will be moved in an arc downward, will closely encircle the clothing items, will pass upward over the base second edge and over the base upper surface, and the tail surface will releasably engage the base panel, the engagement of the tail surface with the base panel defining a primary fastener, and the base panel ends will be moved upward and toward one another, the base panel ends will releasably engage one another above the tail distal end, the engagement of the base panel ends defining a secondary fastener, whereby the secondary fastener will secure the primary fastener in place.

2. The sock keeper of claim 1, wherein the tail is generally flat in cross-section.

3. The sock keeper of claim 2, further comprising:

a central base panel being hook material so as to engage the tail surface and secure the primary fastener;

a first end base panel being hook material; and a second end base panel being loop material so as to engage the first end base panel and secure the secondary fastener, the first and second end base panels straddling the central base panel, the first and second end base panels being disposed adjacent the base ends, the central, first end, and second end base panels extending generally between the base first and second edges.

4. The sock keeper of claim 1, wherein the tail is generally round in cross-section with a periphery, and the tail surface includes loop material around the periphery, so as to increase the area of contact of the primary fastener.

5. A sock keeper for holding a plurality of clothing items together in close juxtaposition, the sock keeper comprising:

a base extending between opposite first and second edges and between opposite ends, one of the base ends having a first tab projecting outward adjacent the base first edge, the opposite base end having a second tab projecting outward adjacent the base second edge, so as to space apart the first and second tabs, allowing manual grasping of the tabs separately, the base having opposite upper and lower surfaces, the base being flexible;

a tail extending from a proximal end adjacent the base first edge to an opposite distal end, the tail being flexible, the tail having a surface of hook-and-loop material;

a central base panel attached to the base upper surface, the central base panel being hook-and-loop material so as to releasably engage the tail surface, the engagement of the central base panel with the tail surface defining a primary fastener; and first and second end base panels attached to the base upper surface and straddling the central base panel, the first and second end base panels being disposed adjacent the base ends, the central, first end, and second end base panels extending generally between the base first and second edges, the first end base panel being hook material, the second end base panel being loop material so as to releasably engage the first end base panel, the engagement of the first end base panel with the second end base panel defining a secondary fastener; so that the tail will be moved in an arc downward, will closely encircle the clothing items, will pass upward over the base second edge and over the base upper surface, and the tail surface will releasably engage the central base panel, securing the primary fastener, and the base first and second tabs will be grasped separately, the first and second end base panels will be moved upward and toward one another, and will releasably engage one another above and closely adjacent the tail distal end, securing the secondary fastener, whereby the secondary fastener will secure the primary fastener in place.

6. The sock keeper of claim 5, wherein the tail surface further comprises loop material, so as not to catch on clothing items.

7. The sock keeper of claim 6, wherein the central base panel further comprises hook material, so as to engage the tail surface.

8. The sock keeper of claim 7, wherein the tail is generally flat in cross-section.

9. The sock keeper of claim 7, wherein the tail is generally round in cross-section with a periphery, and the tail surface includes loop material around the periphery, so as to increase the area of contact of the primary fastener.

10. A sock keeper for holding a plurality of clothing items together in close juxtaposition, the sock keeper comprising:

a base extending between opposite first and second edges and between opposite ends, one of the base ends having a first tab projecting outward adjacent the base first edge, the opposite base end having a second tab projecting outward adjacent the base second edge, so as to space apart the first and second tabs, allowing manual grasping of the tabs separately, the base having opposite upper and lower surfaces, the base being flexible;

a tail extending from a proximal end adjacent the base first edge to an opposite distal end, the tail being flexible, the tail having a surface of hook-and-loop material; and at least one base panel attached to the base upper surface, the base panel extending between opposite first and second edges and between opposite ends, the base panel first and second edges being juxtaposed with the base first and second edges, respectively, the base panel ends being juxtaposed with the base ends, the base panel being hook-and-loop material; so that the tail will be moved in an arc downward, will closely encircle the clothing items, will pass upward over the base second edge and over the base upper surface, and the tail surface will releasably engage the base panel, the engagement of the tail surface with the base panel defining a primary fastener, and the base first and second tabs will be grasped separately, the base panel ends will be moved upward and toward one another, the base panel ends will releasably engage one another above the tail distal end, the engagement of the base panel ends defining a secondary fastener, whereby the secondary fastener will secure the primary fastener in place.

11. The sock keeper of claim 10, wherein the tail surface further comprises loop material, so as not to catch on clothing items.

12. The sock keeper of claim 11, wherein the base panel further comprises hook material, so as to engage the tail surface.

13. The sock keeper of claim 12, wherein the tail is generally flat in cross-section.

14. The sock keeper of claim 12, wherein the tail is generally round in cross-section with a periphery, and the tail surface includes loop material around the periphery, so as to increase the area of contact of the primary fastener.

* * * * *